US007377983B2

(12) United States Patent
Erkenbrecher, Jr. et al.

(10) Patent No.: US 7,377,983 B2
(45) Date of Patent: May 27, 2008

(54) PREVENTION OF DEPOSITS ON CERAMICS

(75) Inventors: Carl William Erkenbrecher, Jr., Elkton, MD (US); John Mark Longoria, Wilmington, DE (US); Richard Alan Reynolds, Middletown, DE (US); Jennifer C. Julian, Castro Valley, CA (US); Malcolm DeLeo, Livermore, CA (US); Maria Garcia Ochomogo, Danville, CA (US)

(73) Assignee: The Clorox Company, Oakland, CA (US)

( * ) Notice: Subject to any disclaimer, the term of this patent is extended or adjusted under 35 U.S.C. 154(b) by 204 days.

(21) Appl. No.: 11/251,432

(22) Filed: Oct. 14, 2005

(65) Prior Publication Data

US 2006/0094623 A1 May 4, 2006

Related U.S. Application Data

(60) Provisional application No. 60/624,917, filed on Nov. 4, 2004.

(51) Int. Cl.
*B08B 3/00* (2006.01)

(52) U.S. Cl. ..... 134/26; 510/238; 510/504; 134/28; 134/29; 134/36; 134/42

(58) Field of Classification Search ..... 510/504, 510/238; 134/26, 28, 29, 36, 42
See application file for complete search history.

(56) References Cited

U.S. PATENT DOCUMENTS

| | | | |
|---|---|---|---|
| 4,719,083 | A | 1/1988 | Baker et al. |
| 4,797,220 | A | 1/1989 | Miller |
| 4,864,075 | A | 9/1989 | Thompson et al. |
| 4,956,099 | A | 9/1990 | Thompson et al. |
| 4,970,211 | A | 11/1990 | Fenyes et al. |
| 5,034,155 | A | 7/1991 | Soeder et al. |
| 5,110,868 | A | 5/1992 | Bellis et al. |
| 5,346,725 | A | 9/1994 | Targosz |
| 5,624,547 | A | 4/1997 | Sudhakar et al. |
| 5,895,781 | A | 4/1999 | Neumiller et al. |
| 5,910,475 | A | 6/1999 | Neumiller et al. |
| 6,013,795 | A | 1/2000 | Manzara et al. |
| 6,255,267 | B1 | 7/2001 | Nayar et al. |
| 6,514,923 | B1 | 2/2003 | Cheung et al. |
| 2002/0002125 | A1* | 1/2002 | Colurciello, Jr. et al. ... 510/238 |
| 2005/0130870 | A1* | 6/2005 | Ochomogo et al. ..... 510/499 |
| 2006/0094623 | A1* | 5/2006 | Erkenbrecher et al. ..... 510/301 |

FOREIGN PATENT DOCUMENTS

| | | | |
|---|---|---|---|
| AU | 9935059 | A | 12/2000 |
| CN | 1138628 | A | 12/1996 |
| CN | 1293153 | A | 5/2001 |
| DE | 3810281 | A | 10/1989 |
| DE | 3928747 | A | 3/1991 |
| DE | 19837068 | A1 | 2/2000 |
| DE | 19914790 | A1 | 10/2000 |
| DE | 19953331 | A1 | 5/2001 |
| EP | 252695 | | 1/1988 |
| EP | 541318 | A1 | 5/1993 |
| EP | 590746 | A1 | 4/1994 |
| EP | 734691 | A2 | 10/1996 |
| FR | 2735462 | A1 | 12/1996 |
| GB | 2289672 | A | 11/1995 |
| GB | 2313369 | A | 11/1997 |
| GB | 2335925 | A | 10/1999 |
| JP | 228340 | | 4/1988 |
| JP | 228341 | | 4/1988 |
| JP | 1996239694 | A | 9/1996 |
| JP | 2000240134 | A | 9/2000 |
| KR | 9505916 | B1 | 6/1995 |
| KR | 2001068640 | A | 7/2001 |
| MX | 9810615 | A1 | 6/2000 |
| MX | 9810616 | A1 | 6/2000 |
| WO | WO 91/05741 | A | 5/1991 |
| WO | WO 96/40856 | A1 | 12/1996 |
| WO | WO 98/00369 | A1 | 1/1998 |
| WO | WO 98/31636 | A1 | 7/1998 |
| WO | WO 00/35833 | A1 | 6/2000 |
| WO | WO 00/63337 | | 10/2000 |

* cited by examiner

*Primary Examiner*—Sharidan Carrillo
(74) *Attorney, Agent, or Firm*—David Peterson; Nancy C. Mayer

(57) ABSTRACT

A method to prevent deposits on a ceramic surface comprising: (1) pretreating the surface by applying an aqueous solution containing from about 200 ppm to about 1000 ppm by weight of an amphoteric fluorosurfactant, and (2) periodically applying an aqueous maintenance solution comprising from about 1 ppm to about 200 ppm of at least one of an amphoteric or cationic fluorosurfactant or a mixture thereof, from about 5 ppm to about 100 ppm of a sequestering acid, and from about 2.5 ppm to about 200 ppm of a quaternary ammonium biocide compound, wherein all concentrations are by weight of aqueous solution is disclosed.

7 Claims, No Drawings

PREVENTION OF DEPOSITS ON CERAMICS

FIELD OF THE INVENTION

This invention relates to the field of cleaning, disinfecting and preventing deposit-formation on ceramic surfaces such as toilet bowls, bathtubs, tiles and other ceramic fixtures.

BACKGROUND OF THE INVENTION

Toilet bowls, shower stalls, sinks and bathtubs accumulate a steady buildup of organic and inorganic deposits on their surfaces as a result of repeated use. There are various causes for this buildup. Deposits are primarily the result of iron, hard water minerals, biological films (biofilms), insoluble soap residues and washed-off debris from the body. All of these deposits create an unsightly and unhealthy environment that is unacceptable from the standpoint of cleanliness and good hygiene, as well as aesthetics. In public rest rooms at commercial establishments, customer reaction to these unsightly deposits can result in direct financial loss as well.

Conventionally, such deposits are cleaned by vigorous scrubbing with a brush or harsh cleanser. Numerous patents claim the use of solutions to make the task easier. The products now marketed for this purpose, in addition to generally providing fragrance, are sold to do one of two things: (1) help control hard water and iron scale deposits, or (2) inhibit bacterial growth and/or minimize biofilm formation, but not both.

Many ingredients recommended for preventing formation of hard-water scales undesirably reduce the effectiveness of ingredients recommended for biofilm prevention, and vice versa. For example, ethylenediamine tetraacetic acid, commonly recommended for removal of hard-water deposits, interferes with the effectiveness of the quaternary biocides by chemically reacting to form a precipitate.

US patent application No. 2002/0002125 discloses an acidic cleaning and disinfecting composition for hard surfaces comprising a film-forming organosilicone quaternary ammonium compound, a zwitterionic amine oxide surfactant, a nonionic surfactant, an organic solvent and water. It optionally contains sulfamic acid, glycolic acid or citric acid.

There is a need for an improved method of preventing both biofilm and hard water scale deposits on ceramic surfaces, preferably one which will prevent deposits for an extended period of time. This invention solves the problem of frequent manual cleaning of ceramic surfaces using a brush or other agent by preventing deposition onto the surface of the primary stains (hard water/iron scale and biofilm). This invention is useful in achieving scale or residue prevention and biofilm prevention at the same time, and for an extended period of time.

SUMMARY OF THE INVENTION

This invention comprises a method to prevent formation of deposits on a ceramic surface comprising (1) pretreating the surface by applying an aqueous solution containing from about 200 ppm to about 1000 ppm by weight of an amphoteric fluorosurfactant, and (2) periodically applying an aqueous maintenance solution comprising from about 1 ppm to about 200 ppm of at least one of an amphoteric or cationic fluorosurfactant, or mixture thereof, from about 5 ppm to about 100 ppm of a sequestering acid, and from about 2.5 ppm to about 200 ppm of a quaternary ammonium biocide compound, wherein all concentrations are by weight of aqueous solution.

DETAILED DESCRIPTION OF THE INVENTION

Trademarks are denoted herein by capitalization. The unit "ppm" is used herein to mean micrograms per gram.

This invention relates to a method for preventing scale, stain and biofilm formation on a ceramic surface for an extended period of time. By a ceramic surface is meant any nonporous glass-like surface such as tile, porcelain, china, glass and similar materials. Preferably the ceramic surface is a porcelain surface such as a toilet bowl, bathtub, tile, or other ceramic surface.

The inventive method employs both a pretreatment step and a maintenance treatment step. In the pretreatment step, a clean ceramic surface is treated with an aqueous solution of from about 200 ppm to about 1000 ppm by weight of an amphoteric fluorosurfactant. Higher concentrations are unnecessarily expensive. Concentrations of about 200 ppm to about 600 ppm by weight are preferred. The pH of the solution is between about 2 and about 10, with a preferred range of about 2 to about 7 and a more preferred range of about 2 to about 4.

The solution is applied to the ceramic surface by wiping, spraying, squirting, brushing, soaking or other means. Preferably it is applied by wiping or brushing.

Amphoteric surfactants suitable for use herein comprise $R_f$—R-Q-$N^+(CH_3)_2CH_2COO$—, $R_f$—R-Q-$N(CH_3)_2O$, or $R_f$—R—$SCH(CO_2^-)CH_2CONH(CH_2)_3N^+(CH_3)_3$ wherein $R_f$ is a straight or branched chain perfluoroalkyl group of 2 to about 20 carbons, R is a methylene or ethylene group, and Q is selected from the group consisting of —$CH(OH)CH_2$—$NH(CH_2)_3$—, —$CH(OCOCH_3)CH_2$—, —$SCH_2CH(OH)CH_2$—, and —$SO_2NH(CH_2)_3$—.

Preferably, the amphoteric fluorosurfactant contains a perfluorinated alkyl group, a connecting group, and an amphoteric solubilizing group such as a betaine. More preferably the amphoteric fluorosurfactant has the formula $$R_fCH_2CH_2SO_2NHCH_2CH_2CH_2N^+(CH_3)_2CH_2COO^-$$

wherein $R_f$ is a perfluorinated chain with the formula $CF_3CF_2(CF_2CF_2)_x$ and x is 2 to 4; or $$R_fCH_2CH(OCOCH_3)CH_2N^+(CH_3)_2CH_2COO^-$$

wherein $R_f$ is a perfluorinated chain with the formula $CF_3CF_2(CF_2CF_2)_x$ and x is 1 to 5.

Alternatively, the amphoteric fluorosurfactant is a fluorinated polymer containing amphoteric functionalities. By this is meant a fluoropolymer wherein fluorinated monomers are reacted with other monomers resulting in a polymeric structure containing fluorinated groups and also having an amphoteric functionality.

In the maintenance step of the method of the present invention, the surface is periodically treated with an aqueous maintenance solution comprising from about 1 ppm to about 200 ppm by weight of an amphoteric and/or cationic fluorosurfactant, from about 5 ppm to about 100 ppm by weight of a sequestering acid and from about 2.5 ppm to about 200 ppm by weight of a quaternary ammonium biocide compound.

By "periodically" is meant at a sufficient frequency to prevent a buildup of scale or biofilm deposits. Preferably the maintenance treatment is performed after each use of the treated facility. When the inventive method is applied to toilets, the preferred frequency of maintenance treatment is once with each toilet flush.

The amphoteric surfactant in the maintenance solution has the composition described previously. The cationic surfactant comprises a) $R_f—(R)_a\text{-}Q\text{-}N^+(CH_3)_3X^-$ wherein $R_f$ is a straight or branched chain perfluoroalkyl group of 2 to about 20 carbons, R is a methylene or ethylene group, a is 0 or 1, X is a halogen, and Q is selected from the group consisting of $—CH(OH)CH_2—NH(CH_2)_3$, $—CH(OCOCH_3)CH_2—$, $—SCH_2CH(OH)CH_2—$, and $—SO_2NH(CH_2)_3—$; or b) a polymer comprising the reaction product of acetic acid with a polymer containing the monomers $R_f—R—OC(O)CR'=CH_2$ and $(R'')_2N(CH_2)OC(O)CR'=CH_2$ and optionally containing at least one of monomers $CH_2OCHCH_2OC(O)C(CH_3)=CH_2$, $CH_3C(O)OCH=CH_2$, $CH_2=C(CH_3)COOH$, or a silane-functional monomer wherein $R_f$ and R are as defined above, R' is hydrogen or methyl, R" is methyl or ethyl.

Preferably the cationic fluorosurfactant contains a perfluorinated alkyl group, a connecting group, and a cationic solubilizing group such as a quaternary ammonium group. More preferably the cationic fluorosurfactant has the formula $$R_fCH_2CH_2SCH_2CH(OH)CH_2N^+(CH_3)_3\ Cl^-$$

wherein $R_f$ is a perfluorinated chain with the formula $CF_3CF_2(CF_2CF_2)_x$ and x is 2 to 9.

Alternatively, the cationic fluorosurfactant may be a fluoropolymer containing cationic functionalities. By this is meant a fluoropolymer wherein fluorinated monomers are reacted with other monomers to form a polymeric structure containing fluorinated groups and cationic groups.

For the maintenance treatment step, fluorosurfactant concentrations higher than 200 ppm by weight of the aqueous solution are unnecessarily expensive. Preferably the concentration is between from about 1 ppm to about 10 ppm by weight of the aqueous solution. The ability to use such small amounts of an amphoteric or cationic fluorosurfactant is surprising, since prior art compositions with anionic or nonionic fluorosurfactants typically required the use of about 100 ppm.

Sequestering acids suitable for use herein include any acid known to sequester iron or calcium in an aqueous system. The sequestering acid is preferably selected from the group consisting of citric, glycolic, lactic, malic, salicylic, oxalic, succinic, glutaric, adipic, pimalic and sulfamic acid. More preferably the sequestering acid is citric acid. The preferred concentration range is from about 10 to about 50 ppm.

The quaternary ammonium biocide compound suitable for use herein is any water-soluble quaternary ammonium compound having biocidal activity. The preferred quaternary biocide is an alkyldimethyl benzyl ammonium chloride, an alkyl dimethyl ethylbenzyl ammonium chloride, or a mixture thereof. Examples of suitable biocides include the BTC series of biocides available from Stepan Company, Northfield, Ill., such as Stepan BTC 2125 M90; the BARDAC and BARQUAT series available from Lonza, Fairlawn, N.J.; and the MAQUAT series available from Mason Chemical, Arlington Heights, Ill. Biocide concentrations above about 200 ppm (active ingredient basis) by weight of the aqueous solution are unnecessarily expensive. The biocide is present at a concentration from about 2.5 ppm to about 200 ppm. The preferred concentration range is from about 5 to about 15 ppm by weight of the biocide active ingredient relative to the weight of the aqueous solution.

The BTC series of biocides from Stepan includes Alkyl dimethyl benzyl ammonium chloride/alkyl dimethyl ethylbenzyl ammonium chloride; Didecyl dimethyl ammonium chloride; Alkyl dimethyl benzyl ammonium chloride/alkyl dimethyl benzyl ammonium chloride; Alkyl dimethyl benzyl ammonium chloride; Alkyl dimethyl benzyl ammonium chloride/dialkyl methyl benzyl ammonium chloride; Octyl decyl dimethyl ammonium chloride/didecyl dimethyl ammonium chloride/dioctyl dimethyl ammonium chloride; and Dimethyl benzyl ammonium chloride/octyl decyl dimethyl ammonium chloride/didecyl dimethyl ammonium chloride/dioctyl dimethyl ammonium chloride.

The BARDAC series of biocides from Lonza includes Alkyl dimethyl benzyl ammonium chloride/octyl decyl dimethyl ammonium chloride/didecyl dimethyl ammonium chloride/dioctyl dimethyl ammonium chloride; Alkyl dimethyl benzyl ammonium chloride, dialkyl dimethyl ammonium chloride; Octyl decyl dimethyl ammonium chloride/didecyl dimethyl ammonium chloride/dioctyl dimethyl ammonium chloride; and Didecyl dimethyl ammonium chloride.

The BARQUAT series from Lonza includes Alkyl dimethyl benzyl ammonium chloride; Alkyl dimethyl benzyl ammonium chloride/dialkyl methyl benzyl ammonium chloride; and Alkyl dimethyl benzyl ammonium chloride/dialkyl methyl ethyl benzyl ammonium chloride.

The MAQUAT series by Mason Chemical-Alkyl dimethyl benzyl ammonium chloride; Didecyl dimethyl ammonium chloride; Didecyl dimethyl ammonium chloride and alkyl dimethyl benzyl ammonium chloride; and Alkyl dimethyl benzyl ammonium chloride.

Optionally the pretreatment solution and/or maintenance solution also contains other ingredients such as fragrance, fragrance enhancers, coloring agents, auxiliary surfactants, auxiliary disinfectants, builders, promoters, stabilizers, solvents, thickeners and corrosion inhibitors.

The pretreatment and maintenance solutions are prepared by conventional means by dissolving desired weights of the components in water. The chemicals can be predissolved in a small amount of water and then diluted.

It has been found that the pretreatment and maintenance steps as previously described are effective in treating the ceramic surface in a way that effectively prevents scale buildup for an extended period of time. The addition of a cationic fluorosurfactant in the maintenance solution is also helpful in preventing biofilm from building on the ceramic surface, even at concentrations so low as to leave the surrounding microbial population unaffected, permitting economical use of this ingredient.

This invention solves the problem of frequent manual cleaning of ceramic surfaces using a brush or other agent by preventing deposition onto the surface of the primary stains (hard water/iron scale and biofilm). This invention is useful in achieving scale or residue prevention and biofilm prevention at the same time, and for an extended period of time.

The following equipment was used in the examples herein. A multi-unit toilet simulator was developed for the purpose of producing hard water stains on porcelain or ceramic tiles. The simulator consisted of a pump (Cole-Parmer Masterflex L/S pump model 7550-20) with computer-controlled flow, four pump heads (Masterflex Easy-Load II pump heads model 77200-50), 12 simulated toilet tubs and 4 reservoirs for recycling the hard water solution.

The simulator flow was a closed loop system to recycle the hard water solution. Hard water solution was placed in carboy reservoirs, located below the plane of the apparatus for drainage. Tubing ran up from the carboys to the pump. Water was pumped through the tubing to a manifold which split the individual pump head flow 3 ways to 3 plastic tubs. A valve was located on each leg of the manifold to aid in controlling and calibrating the water flow. A spray nozzle was located at the end of each leg. The spray nozzle was made of a piece of narrow diameter rigid tubing drilled with six 1/16 inch (0.16 cm) holes covering a 4 inch (10.16 cm) length in order to stay within the plane of a test tile. The far end of the nozzle was plugged. The manifold, tubing, valves and nozzles were all supported with common laboratory support rods. The nozzles were located parallel to the tiles and touching them to produce a trickle flow of water simulating a flush. The test tiles were partially submerged in the liquid in the plastic catch tubs, in order to simulate the surfaces of a toilet both above and below the water line.

Water flowed down the tiles for about 20 seconds while the pump was programmed "on" during the flush portion of the cycle. Water flowed off the tile and into the plastic tub leaving both a "trickle stain" as well as a "water level stain" on the tile. An overflow drain was located near the top of the tub at the desired overflow level using a piece of rigid tubing and sealant. Excess water drained out the overflow and back down attached tubing to the original carboys.

The cycle time was a 20-second flush followed by a 5-minute drying cycle to allow the hard water to dry on the tile. To facilitate this drying, a piece of tubing was located across the tub from the tile and attached to a laboratory support rod. The tubing was likewise drilled and strategically located facing the tile from a distance of several inches. Airflow to this tubing was adjusted to be light enough to dry the water between runs but not strong enough to divert the water flow. Airflow was continuous but low flow. Typical runs were made for 3 or 4 days of continuous operation.

EXAMPLE 1

Black porcelain tiles (obtained from Home Depot, Wilmington, Del.) were cleaned and pretreated for 10 minutes by soaking in an aqueous solution of 200 ppm of a fluorosurfactant of formula $$R_fCH_2CH(OCOCH_3)CH_2N^+(CH_3)_2CH_2COO^-$$

wherein $R_f$ is a perfluorinated chain with the formula $CF_3CF_2(CF_2CF_2)_x$ and x is 1 to 5.

The tiles were then placed in the simulated toilet equipment described above for 96 hours. The toilet rig delivered a 10-second "flush" of maintenance treatment solution over the tile every 5 minutes. As such, the tiles received 1156 flushes in 4 days.

The maintenance treatment solution used to flush in the test contained: 5 ppm of the fluorosurfactant described above for pretreatment, 50 ppm citric acid and 10 ppm Stepan BTC2125M90 quaternary ammonium compound (biocide), available from Stepan Company, Northfield, Ill., dissolved in 150 ppm hard water to simulate typical hard water conditions.

When removed, the tiles had a very slight film in 3 tight lines down the tile. The results were an estimated 95% improvement over tiles flushed with hard water without the maintenance treatment solution and no pretreatment. The latter showed very noticeable levels of hard water/iron scale buildup.

EXAMPLE 2

Microscope slides were cleaned and pretreated by soaking for 10 minutes in a solution of 200 ppm the fluorosurfactant used in Example 1. The slides were then placed in commercial laboratory biofilm generator/reactors from VWR International, West Chester, Pa. The reactors were designed to contain starter colonies of common bacteria found in toilets, Tryptic Soy Broth (hereafter TSB) for nourishment of cells, and any treatment solution. Reactors were flushed twice daily (charged with new cells, TSB and maintenance solution) for two days to both simulate flushing yet give cells enough time to stabilize and form biofilm.

The reactor solution contained (on each flush) 5 ppm of the same fluorosurfactant used in the pretreatment, 20 ppm citric acid and 2.5 ppm Stepan BTC 2125M90 quaternary ammonium compound (biocide), 8 ml of TSB solution, 784 ml of tap water, and 100 microliters of cells for a total of 800 ml of solution.

The plate counts from cells scraped from the control reactor resulted in an average of $9.3\times10^7$ CFU/cm$^2$ (Colony Forming Units or "cells") while the plate counts from cells scraped from the reactor containing the maintenance solution described above resulted in an average of $4\times10^1$ CFU/cm$^2$ or "no viable cells". The results of these tests showed inhibition of the growth of biofilm.

EXAMPLE 3

Twelve black porcelain tiles were soaked in a tray of CLOROX bleach for one hour, rinsed with water and washed in a dishwasher on the regular wash cycle. Then, the surface of each tile was scrubbed with FORMULA 409 surface cleaner to remove any excess residue left. The tiles were placed in an oven at 50° C. to dry over night.

The twelve tiles were taken out of the oven and placed on a counter to cool for 15 minutes. Three tiles were pretreated in a glass dish plate with 500 ml of a solution containing 400 ppm of a fluorosurfactant as described below for line 2 for 2 minutes and then placed under line 2 of the toilet rig. Three more tiles were pretreated in a glass dish plate with 500 ml of a solution containing 400 ppm of the fluorosurfactant as described for line 3 below for 2 minutes and then placed under line 3 of the toilet rig. Three more tiles were pretreated in a glass dish plate with 500 ml of a solution containing 400 ppm of the fluorosurfactant described below for line 4 for 2 minutes and then placed under line 4 of the toilet rig. The last 3 untreated tiles were placed under line 1 of the toilet rig for the control.

The control solution (standard hard water) contained 150 ppm hardness ($CaCl_2$) and 3 ppm rust ($FeO_3$). Six liters of control solution were made for each of the 4 lines in the toilet simulator described above. Line 1 contained only 6 liters of the control solution.

Line 2 contained 6 liters of control solution plus 5 ppm of formula fluorosurfactant $R_fCH_2CH(OCOCH_3)CH_2N^+(CH_3)_2\ CH_2COO^-$ wherein $R_f$ is a perfluorinated chain with the formula $CF_3CF_2(CF_2CF_2)_x$ and x is 1 to 5; 5 ppm Stepan BTC2125M90 biocide; and 20 ppm citric acid.

Line 3 contained 6 liters of control solution, plus 5 ppm fluorosurfactant of formula $R_fCH_2CH_2SO_2NHCH_2CH_2CH_2N^+(CH_3)_2CH_2COO^-$ wherein $R_f$ is a perfluorinated chain with the formula $CF_3CF_2(CF_2CF_2)_x$, and x is 2 to 7; 5 ppm Stepan BTC2125M90; and 20 ppm Citric acid.

Line 4 contained 6 liters of control solution, plus 5 ppm fluorosurfactant of formula $R_fCH_2CH_2SO_2NH(CH_2)_3N^+(CH_3)_2CH_2COO^-$ wherein $R_f$ is a perfluorinated chain with the formula $CF_3CF_2(CF_2CF_2)_x$, wherein x is 2; 5 ppm Stepan BTC2125M90; and 20 ppm citric acid.

The fluorosurfactants used herein are available from E. I. du Pont de Nemours and Company, Wilmington, Del. The toilet simulator described above ran for 96 hours and the tiles received 1156 flushes in 4 days. The treated tiles had a slight film formed in about 3-5 lines down the tiles. Colorimeter readings were taken on each tile to determine the performance of the treated tiles compared to the control. The line 2 tiles showed a 77.5% improvement over the control tiles. The line 3 tiles showed an 86.3% improvement over the control tiles and the line 4 tiles showed an 84.4% improvement over the control tiles.

EXAMPLES 4-7

These examples were conducted using the same procedure as Example 3, except that different fluorochemicals were tested in each line of the toilet rig. The fluorochemicals tested in each line for each example contained the same concentrations as in Example 1 and are illustrated in Table 1. Line 1 of the toilet rig was always used as a control line. The fluorosurfactants A through K are available from E. I. du Pont de Nemours and Company, Wilmington, Del. Fluorosurfactant L is available from the 3M Company, Minneapolis, Minn. Fluorosurfactant M is available from Ciba Specialty Chemicals, (Basel, Switzerland). Fluorosurfactant N is available from Asahi Glass Co., (Tokyo, Japan).

The test results are shown in Table 2.

TABLE 1

| Fluorochemical Designation | Fluorochemical Formula |
|---|---|
| A | $CF_3CF_2(CF_2CF_2)_xCH_2CH_2SO_2NHCH_2CH_2N^+(CH_3)_2CH_2COO^-$ x = 1 to 5 |
| B | $CF_3CF_2(CF_2CF_2)_xCH_2CH_2SO_2NHCH_2CH_2N^+(CH_3)_2CH_2COO^-$ x = 2 to 7 |
| C | $CF_3CF_2(CF_2CF_2)_xCH_2CH_2SO_2NHCH_2CH_2N^+(CH_3)_2CH_2COO^-$ x = 2 |
| D | Reaction product of acetic acid with polymer containing diethylaminoethyl methacrylate and perfluoroalkylethyl methacrylate monomers |
| E | Reaction product of acetic acid with polymer containing perfluoroalkylethyl acrylate, dimethylaminoethyl methacrylate and vinyl acetate monomers |
| F | $CF_3CF_2(CF_2CF_2)_xCH_2CH_2SO_2NH(CH_2)_3N(CH_3)_2 \rightarrow 0$ |
| G | Homolog of E |
| H | Reaction product of acetic acid with polymer containing perfluoroalkylethyl methacrylate, diethylaminoethyl methacrylate and glycidyl methacrylate monomers |
| I | $CF_3CF_2(CF_2CF_2)_xCH_2CH_2SCH_2CH(OH)CH_2N^+(CH_3)_3Cl^-$ wherein x is 2 to 9 |
| J | Homolog of H |
| K | Reaction product of acetic acid with polymer containing perfluoroalkylethyl acrylate, dimethylaminoethyl methacrylate, vinyl acetate, methacrylic acid and silane functional monomers |
| L | $C_8F_{17}SO_2NH(CH_2)_3N^+(CH_3)_3$ |
| M | $CF_3CF_2(CF_2CF_2)_xCH_2CH_2SCH(CO_2^-)CH_2CONH(CH_2)_3N^+(CH_3)_3$ wherein x is 1 to 8 |
| N | $C_8F_{17}CH_2CH(OH)CH_2NH(CH_2)_3N^+(CH_2)_2CH_2COO^-$ |

TABLE 2

| Example | Toilet Line | Fluorochemical | Fluorochemical Description | % Improvement vs Control |
|---|---|---|---|---|
| 3 | Line 2 | A | amphoteric fluorosurfactant | 77.5 |
| | Line 3 | B | amphoteric fluorosurfactant | 86.3 |
| | Line 4 | C | amphoteric fluorosurfactant | 84.4 |
| 4 | Line 2 | D | Cationic fluorosurfactant (polymeric) | 59.8 |
| | Line 3 | E | Cationic fluorosurfactant (polymeric) | 55.2 |
| | Line 4 | F | amphoteric fluorosurfactant | 68.0 |
| 5 | Line 2 | L | Cationic fluorosurfactant | 84.5 |
| | Line 3 | M | amphoteric fluorosurfactant | 72.6 |
| | Line 4 | G | cationic fluorosurfactant (polymeric) | 58.4 |
| 6 | Line 2 | H | cationic fluorosurfactant (polymeric) | 51.8 |
| | Line 3 | I | cationic fluorosurfactant | 78.9 |
| 7 | Line 2 | J | cationic fluorosurfactant (polymeric) | 47.8 |

TABLE 2-continued

| Example | Toilet Line | Fluorochemical | Fluorochemical Description | % Improvement vs Control |
|---|---|---|---|---|
| | Line 3 | K | cationic fluorosurfactant (polymeric) | 52.7 |
| | Line 4 | N | amphoteric fluorosurfactant | 48.9 |

The above tests demonstrated that all of the amphoteric and catatonic fluorosurfactants tested showed lower film deposition than the control. In general, polymeric cationic fluorosurfactants tested did not perform as well as the non-polymeric cationic fluorosurfactants tested.

What is claimed is:

1. A method for preventing formation of deposits on a ceramic surface comprising:

(1) pretreating the surface by applying an aqueous solution containing from about 200 ppm to about 1000 ppm by weight of an amphoteric fluorosurfactant having the formula $R_f—CH_2CH_2—SO_2NH(CH_2)_3—N^+(CH_3)_2CH_2COO^-$ wherein $R_f$ is $CF_3CF_2(CF_2CF_2)_x$ and x is 2 to 7, and (2) periodically applying an aqueous maintenance solution comprising from about 1 ppm to about 200 ppm of said amphoteric fluorosurfactant or a mixture thereof, from about 5 ppm to about 100 ppm of a sequestering acid, and from about 2.5 ppm to about 200 ppm of a quaternary ammonium biocide compound, wherein all concentrations are by weight of aqueous solution.

2. The method of claim 1 wherein the pretreatment solution contains from about 200 ppm to about 600 ppm by weight of an amphoteric fluorosurfactant, and the maintenance solution contains from about 1 ppm to about 10 ppm by weight of at least one amphoteric fluorosurfactant, from about 10 ppm to about 50 ppm by weight of a sequestering acid and from about 5 ppm to about 15 ppm by weight of a quaternary ammonium biocide compound.

3. The method of claim 1 wherein the amphoteric fluorosurfactant has the formula $$R_fCH_2CH_2SO_2NHCH_2CH_2CH_2N^+(CH_3)_2CH_2COO^-,$$

wherein $R_f$ is a perfluorinated chain with the formula $CF_3CF_2(CF_2CF_2)_x$ wherein x is 2 to 4.

4. The method of claim 1 wherein the sequestering acid is selected from the group consisting of citric, glycolic, lactic, malic, salicylic, oxalic, succinic, glutaric, adipic, pimalic and sulfamic acids.

5. The method of claim 1 wherein the quaternary ammonium biocide compound is an alkyl dimethyl benzyl ammonium chloride, an alkyl dimethyl ethylbenzyl ammonium chloride, or a mixture thereof.

6. The method of claim 1 wherein the maintenance solution further comprises at least one of a fragrance, fragrance enhancer, coloring agent, surfactant, disinfectant, builder, promoter, stabilizer, solvent, thickener or corrosion inhibitor.

7. The method of claim 4 wherein the sequestering acid is citric acid.

* * * * *